United States Patent [19]

Guers et al.

[11] Patent Number: 5,026,086

[45] Date of Patent: Jun. 25, 1991

[54] DEVICE FOR ABSORPTION OF SHOCKS AND VIBRATIONS BETWEEN A SKI AND A BINDING

[75] Inventors: Francois Guers, Annecy; Axel Phelipon, Annecy Le Vieux, both of France

[73] Assignee: Salomon S.A., Annecy, France

[21] Appl. No.: 431,202

[22] Filed: Nov. 3, 1989

[30] Foreign Application Priority Data

Nov. 4, 1988 [FR] France ..... 8815778

[51] Int. Cl.[5] ..... A63C 5/00

[52] U.S. Cl. ..... 280/607; 280/610

[58] Field of Search ..... 280/602, 607, 609, 610, 280/617, 636

[56] References Cited

U.S. PATENT DOCUMENTS

| | | | |
|---|---|---|---|
| 1,858,120 | 5/1932 | Stevens | 280/607 |
| 3,198,537 | 8/1965 | Silberman | 280/617 |
| 3,537,717 | 11/1970 | Caldwell | 280/602 |
| 4,896,895 | 1/1990 | Bettosini | 280/607 |

FOREIGN PATENT DOCUMENTS

| | | | |
|---|---|---|---|
| 2255406 | 5/1974 | Fed. Rep. of Germany | 280/607 |
| 2259375 | 6/1974 | Fed. Rep. of Germany | 280/607 |
| 2535847 | 2/1977 | Fed. Rep. of Germany . | |
| 2705199 | 8/1978 | Fed. Rep. of Germany | 280/607 |
| 2723864 | 11/1978 | Fed. Rep. of Germany | 280/607 |
| 2374922 | 7/1978 | France . | |
| 2380795 | 9/1978 | France . | |
| 2409776 | 6/1979 | France . | |
| 80939 | 10/1952 | Norway | 280/607 |
| 8303360 | 10/1983 | World Int. Prop. O. . | |
| 8801190 | 2/1988 | World Int. Prop. O. . | |

*Primary Examiner*—Charles A. Marmor
*Assistant Examiner*—Michael Mar
*Attorney, Agent, or Firm*—Sandler, Greenblum & Bernstein

[57] ABSTRACT

A device for absorbing shocks and vibrations between a ski and a binding includes a platform having a layer of shock absorbing material. The binding is attached to the platform by screws extending into the shock absorbing material or into a plate covering the layer. The platform is glued to the upper layer of the ski so that no screws extend into the ski.

27 Claims, 1 Drawing Sheet

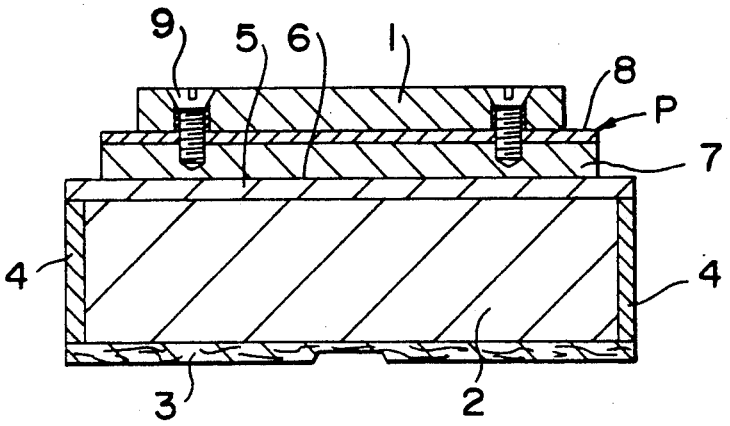
Fig- 1
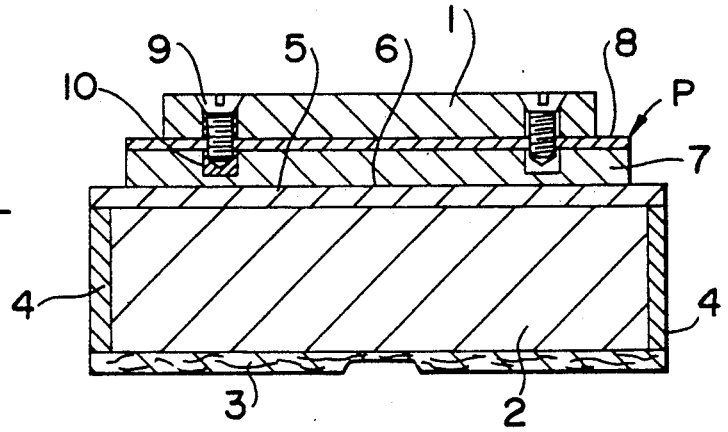
Fig- 1a
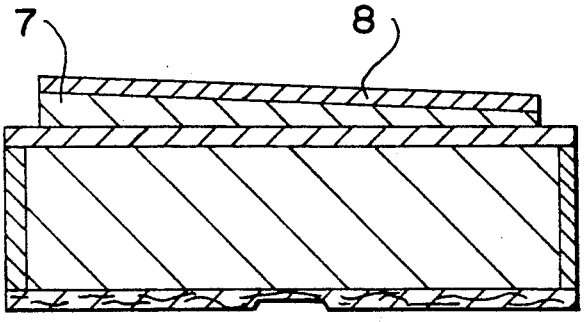
Fig- 2
Fig- 3
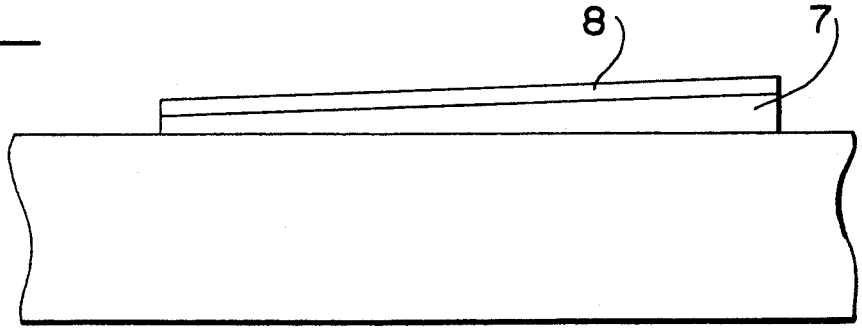

DEVICE FOR ABSORPTION OF SHOCKS AND VIBRATIONS BETWEEN A SKI AND A BINDING

BACKGROUND OF THE INVENTION

1. Field of the Invention

The present invention relates to shock absorbers inserted between a ski boot binding and either a downhill or cross-country ski.

2. Description of Background and Relevant Information

Shock absorbers are adapted to improve the comfort of the skier and also to improve the control and performance of the skis. Without shock absorbers, all irregularities in the slopes, which are even harder the more they are packed down, subject the ski to shocks and vibrations which are transmitted directly to the skier, thus jolting the bones, joints, muscles and tendons. This causes discomfort and fatigue which can lead to accidents. In addition, a connection between the skier and the ski which is too stiff is detrimental to good control of the skis, particularly by too great a grip of the edges in the snow, which can cause inadvertent braking.

A number of attempts have been made to resolve these problems. Elastic material, such as viscoelastic material, has become known to be positioned between the binding and the ski.

French Patent No. 2,374,922 provides shock absorption blocks which are penetrated by screws for securing a binding support plate to the ski. These blocks absorb certain troublesome forces, but the screws being anchored in the ski itself causes these forces, shocks or vibrations to pass through the screws, whose anchoring area therefore has a tendency to enlarge and thus damage the ski.

In PCT document WO 83/03 360, a shock absorber constituted by an elastomeric layer and at least one metallic layer is disclosed as being positioned between the upper surface of the ski and the binding. But again, the securing of the shock absorber to the ski by screws anchored in the ski creates the same disadvantages as those mentioned above.

The same disadvantages are also found in the device proposed in French Patent No. 2,409,776, which includes screws extending into the ski.

To diminish the effect of unscrewing and damaging of the ski by the screws, it has been customary to put glue in the screw holes to re-establish the watertightness of the drilled core of the ski and to prevent unscrewing, but this only delays the undesirable effects which are never eliminated, being only temporarily hidden.

SUMMARY OF THE INVENTION

An object of the present invention is to eliminate the aforementioned harmful effects by providing a method of securing which ensures the absorption of shocks and vibrations between the binding and ski, thus making it possible to avoid anchoring the screws directly in the core of the ski, or into the mechanical parts of the ski.

The present invention is directed to a device for absorbing shocks and vibrations between a ski having an upper surface and a binding for the shoe or boot of a skier. The device includes at least one platform having at least one layer of shock absorbing material for mounting on the upper surface of the ski in the areas provided for the binding. The binding is adapted to be connected to the platform, and the platform is connected to the upper surface of ski so that no screws extend into the ski. Preferably, the platform is glued to the upper surface of the ski. The binding is connected to the platform by screws which are anchored directly in the layer of shock absorbing material. Alternatively, the screws for securing the binding may be anchored in shanks, which are solidly affixed to the shock absorbing layer.

According to an object of the invention, the layer is covered by a rigid plate to form the platform. The binding is connected to the platform by screws, with the rigid plate being drilled in the locations provided for the screws so that the screws extend into the layer. Alternatively, the binding may be connected to the platform by screws which are anchored directly in the rigid plate.

According to another object of the invention, the platform may be a single piece extending with the binding at the rear and at the front of the skier's boot, or the platform may be in the form of two separate elements adapted to be located at a rear and a front binding, respectively, of the boot on the ski.

Preferably, the layer of shock absorbing material is a viscoelastic material having a shock absorption coefficient between approximately 0.8 and 1.2 and a hardness between 30 and 70 Shore A. The viscoelastic material may be polyurethane, polyisoprene, polyisobutylene, or polyisoxylane.

According to another object of the invention, the platform has a transversely and/or longitudinally variable thickness.

The invention is also directed to the combination of the ski and the device for absorbing shocks and vibrations between the ski and binding which secures a boot of a skier to the ski. A platform is provided having at least one layer of shock absorbing material, which is secured to the upper surface of the ski in the area provided for the binding, whereby the binding is adapted to be secured to the platform with no screws extending into said ski.

BRIEF DESCRIPTION OF THE DRAWINGS

The invention is further explained in the description which follows with reference to the drawings illustrating, by way of non-limiting examples, various embodiments of the invention wherein:

FIG. 1 shows, in transverse section, a ski to which a shock and vibration absorption device according to the invention is applied;

FIG. 1*a* shows, in transverse section, an alternative embodiment of the shock and vibration absorption device of FIG. 1;

FIG. 2 is a transverse sectional view of an embodiment of the invention with the binding not shown; and FIG. 3 is a side view illustrating another embodiment of the shock absorbing device.

DETAILED DESCRIPTION OF THE PREFERRED EMBODIMENTS

FIG. 1 shows, in transverse section, a shock absorbing device according to the invention which is mounted to a ski at the position of binding 1, which is represented by a conventional base plate. This ski, in the usual manner, includes core 2 enclosed between bottom piece 3, edges 4, and an upper element 5, which is covered by a layer of material 6 for reinforcement, protection and appearance.

At the locations where the binding 1 is to be secured to the ski by screws 9, platform P is positioned on the upper surface of the ski. The platform is secured to the ski, preferably by gluing, which would be within the understanding of one of ordinary skill in the art.

Platform P is formed of a layer 7 of material for absorbing shocks and vibrations, and is preferably covered by rigid plate 8, which it is solidly affixed to layer 7, for example by gluing. This gluing is preferably done before mounting of the platform on the ski.

The material selected for layer 7 is preferably viscoelastic to absorb the energy applied during deformations. Its coefficient of shock absorption should be clearly different from zero and it is contemplated that it could extend to a value of approximately 1.2. The hardness of the material can be selected in the range extending from approximately 30–70 Shore A. Materials permitting the expected result, particularly shock absorption without destroying good control of the skis can be selected from polyurethane, polymethylene, polyisoprene, polyisobutylene, and polyisoxylane.

According to the invention, screws 9 for securing binding 1 to the ski, are neither anchored in core 2 of the ski, nor anchored in elements 5, 6 as is the conventional technique, but are anchored in platform P. Thus, the shocks and vibrations of the ski towards binding 1, or vice versa, are not directly transmitted, but pass through the center of the shock absorber so that platform P absorbs at least a large part of the energy.

The screws 9 for binding 1 can be directly anchored in layer 7 of the shock absorbing material which must then have a sufficient thickness to permit the vertical extension of the screws. The screws can thus be anchored there indirectly by means of tapped or self-tapping anchoring shanks or sleeves 10, as shown in FIG. 1*a*, which may deform during screwing. The anchoring sleeves can be inserted in layer 7 and then solidly affixed by gluing, or they can be embedded therein in a conventional manner during the vulcanization of layer 7. Preferably, when layer 7 is covered with rigid plate 8, the plate can include, in the locations provided for screws 9, threaded or self-tapping holes. These holes depend upon the materials used and do not have to be previously drilled, but can be formed by the screwing operation itself.

Platform P, which is located in the binding zones, can be a single piece relating to the binding assembly 1 of the skier's boot. Of course, it is possible to provide, depending upon the type of binding, two separate platforms, with one attached to a front binding and the other to a heel binding.

Moreover, the platform or platforms can have a layer 7 of transversely variable shock absorbing material to improve the comfort of the skier and the control of his skis during the gripping of the edges and/or can be longitudinally variable with respect to the ski to improve the comfort of the heel, for example, for passing over moguls and/or for skiers having a tendency to lean strongly towards the front or rear, as is shown in FIGS. 2 and 3, respectively.

Although the invention has been described with reference to particular means, materials and embodiments, it is to be understood that the invention is not limited to the particulars disclosed and extends to all equivalents within the scope of the claims.

We claim:

1. Device for absorbing shocks and vibrations between a ski having an upper surface and a binding for the shoe or boot of a skier, said device comprising at least one platform having at least one layer of viscoelastic shock absorbing material, a lower surface of said shock absorbing material being adapted to be mounted solely by adhesive means onto the upper surface of the ski in an area provided for the binding, a rigid plate attached by adhesive means to an upper surface of said shock absorbing material, and screws having a predetermined length for securing said binding to an upper surface of said rigid plate, wherein said screws extend through said rigid plate and are anchored directly into said shock absorbing material and wherein said screws extend into said shock absorbing material but do not penetrate into the upper surface of the ski.

2. Device according to claim 1, wherein said platform is glued to the upper surface of said ski.

3. Device according to claim 1, wherein said screws for securing the binding are anchored in shanks, which are solidly affixed to said layer.

4. Device according to claim 1, wherein said rigid plate has holes drilled in predetermined locations provided for said screws so that said screws extend into said layer.

5. Device according to claim 1, wherein said screws are anchored directly in said rigid plate.

6. Device according to claim 1, wherein said platform is a single piece extending with said binding at the rear and at the front of the skier's boot.

7. Device according to claim 1, wherein said platform is in the form of two separate elements respectively adapted to be located at the rear and at the front of the binding of the boot on the ski.

8. Device according to claim 1, wherein said platform includes a transversely variable thickness.

9. Device according to claim 1, wherein said viscoelastic material has a shock absorption coefficient between approximately 0.8 and 1.2.

10. Device according to claim 1, wherein said viscoelastic material has a hardness between 30 and 70 Shore A.

11. Device according to claim 1, wherein said viscoelastic material is polyurethane.

12. Device according to claim 1, wherein said viscoelastic material is polyisoprene.

13. Device according to claim 1, wherein said viscoelastic material is polyisobutylene.

14. Device according to claim 1, wherein said viscoelastic material is polyisoxylane.

15. Device according to claim 1, wherein said platform includes a longitudinally variable thickness.

16. Device according to claim 1, wherein said platform includes a transversely and longitudinally variable thickness.

17. A combination ski and device for absorbing shocks and vibrations between the ski and a binding for securing a boot of a skier to said ski, said combination comprising:

(a) a ski having an upper surface, a core, and an area provided for binding;

(b) a platform having at least one layer of viscoelastic shock absorbing material, said platform being secured to the upper surface of said ski in said area provided for the binding solely by adhesive means; and (c) a rigid plate attached by adhesive means to an upper surface of said shock absorbing material whereby said platform is adapted to be secured to said binding by screws having a predetermined length, said screws extending through said rigid plate and being anchored directly into said layer of shock absorbing material, wherein said screws extend into said shock absorbing material but do not penetrate into the upper surface of the ski.

18. The combination according to claim 17, wherein said platform is glued to the upper surface of said ski.

19. The combination according to claim 17, wherein said viscoelastic material has a shock absorption coefficient between 0.8 and 1.2.

20. The combination according to claim 17, wherein said viscoelastic material has a hardness between 30 and 70 Shore A.

21. The combination according to claim 17, wherein shanks are solidly affixed to said layer, said screws being anchored in said shanks.

22. The combination according to claim 17, wherein said screws are anchored directly in said rigid plate.

23. The combination according to claim 17, said rigid plate having drilled holes in predetermined locations provided for said screws.

24. The combination according to claim 23, wherein said platform includes a transversely variable thickness.

25. The combination according to claim 17, wherein said platform includes a longitudinally variable thickness.

26. The combination according to claim 17, wherein said platform includes a transversely and longitudinally variable thickness.

27. The combination according to claim 17, further including a binding secured to said platform.

* * * * *